US012767291B2

(12) United States Patent
Mayall et al.

(10) Patent No.: US 12,767,291 B2
(45) Date of Patent: Oct. 20, 2026

(54) LIFEBOAT

(71) Applicant: Zelim Limited, Denbighshire (GB)

(72) Inventors: Samuel Mayall, Denbighshire (GB); Douglas Lothian, Longniddry (GB); Andrew Page, Hampshire (GB); Guido De Mola, Hampshire (GB)

(73) Assignee: Zelim Limited, Denbighshire (GB)

( * ) Notice: Subject to any disclaimer, the term of this patent is extended or adjusted under 35 U.S.C. 154(b) by 449 days.

(21) Appl. No.: 18/276,336

(22) PCT Filed: Feb. 8, 2022

(86) PCT No.: PCT/GB2022/050336

§ 371 (c)(1),
(2) Date: Aug. 8, 2023

(87) PCT Pub. No.: WO2022/167824

PCT Pub. Date: Aug. 11, 2022

(65) Prior Publication Data

US 2024/0116609 A1 Apr. 11, 2024

(30) Foreign Application Priority Data

Feb. 8, 2021 (GB) ..... 2101725

(51) Int. Cl.
*B63C 9/02* (2006.01)
*B63B 27/14* (2006.01)

(52) U.S. Cl.
CPC ..... *B63C 9/02* (2013.01); *B63B 27/143* (2013.01)

(58) Field of Classification Search
CPC .. B63C 9/00; B63C 9/02; B63C 9/026; B63C 2009/035; B63B 27/14; B63B 27/141;
(Continued)

(56) References Cited

U.S. PATENT DOCUMENTS 2,568,330 A 9/1951 Flippin
3,596,623 A 8/1971 Frankel
(Continued)

FOREIGN PATENT DOCUMENTS

CN 106672167 5/2017
CN 210503082 5/2020
(Continued)

OTHER PUBLICATIONS

International Search Report, European Patent Office, Jun. 14, 2022.
(Continued)

*Primary Examiner* — Daniel V Venne
(74) *Attorney, Agent, or Firm* — Bay State IP, LLC

(57) ABSTRACT

A life boat is disclosed having a hull, a propulsion system, and a conning system. The hull has an open or openable bow, a fore deck and a powered recovery ramp installed in or on the fore deck for deployment forwards of the bow for recovery of a casualty ahead of the bow of the life boat. The life boat may be unmanned and able to draw a survivor up on the recovery ramp and into the relative safety of the rescue deck area of the fore deck without human assistance. The life boat 1 may include a cabin area where the survivor can be given more protection from the environment.

20 Claims, 7 Drawing Sheets

(58) Field of Classification Search
CPC ..... B63B 27/143; B63B 27/22; B63B 27/36; B63B 19/08; B63B 2019/083; B63B 35/00; B63B 2035/006
USPC ..... 114/117, 343, 348, 349, 362, 364
See application file for complete search history.

(56) References Cited

U.S. PATENT DOCUMENTS

| | | | | |
|---|---|---|---|---|
| 4,031,583 | A * | 6/1977 | Phillips, II | B63B 27/14 193/25 B |
| 4,989,691 | A * | 2/1991 | Wilkerson | B63B 27/146 182/51 |
| 5,301,630 | A * | 4/1994 | Genovese | B63B 27/14 244/905 |
| 5,492,076 | A * | 2/1996 | Kobayashi | B63C 9/02 440/89 C |
| 5,597,335 | A * | 1/1997 | Woodland | B63B 7/082 114/348 |
| 12,077,268 | B2 * | 9/2024 | Mayall | G05D 1/227 |
| 2005/0257732 | A1 | 11/2005 | Waldock | |
| 2006/0065586 | A1 | 3/2006 | Walczyk | |
| 2014/0158038 | A1 | 6/2014 | Johnston | |
| 2017/0320550 | A1 | 11/2017 | Ryan | |
| 2018/0257745 | A1 | 9/2018 | De Waal | |

FOREIGN PATENT DOCUMENTS

| | | |
|---|---|---|
| CN | 111 727 151 A | 9/2020 |
| EP | 3663187 | 6/2020 |
| GB | 1585865 | 3/1981 |
| WO | 2012007002 | 1/2012 |
| WO | 2019158904 | 8/2019 |

OTHER PUBLICATIONS

Written Opinion ISA, European Patent Office, Jun. 14, 2022.
Combined Search & Examination Report, UK IPO, Jul. 15, 2022.
Office Action from Chinese Patent Office (Original and English Translation).

* cited by examiner

LIFEBOAT

CROSS REFERENCE TO RELATED APPLICATION

This application is for entry into the U.S. National Phase from which priority is claimed under all applicable sections of Title 35 of the United States Code including, but not limited to, Sections 120, 363, and 365(c) to International Application No. PCT/GB2022/050336 filed on Feb. 8, 2022, and which in turn claims priority under 35 USC 119 to Great Britain Patent Application No. 2101725.6 filed on Feb. 8, 2021.

The present invention relates to a life boat with a casualty recovery ramp.

WO2019/158904 discloses an embodiment of an unmanned lifeboat which has a hull with a transom opening, and a fo'c'sle closed by a rounded top deck that is able to provide accommodation for survivors. The aft deck as such is generally U-shaped with a cut-out open at the transom, which is vestigial with two small port and starboard parts. Within the cut-out is a boarding assistance ramp. This is level with the aft deck at its forward end and slopes down to the transom. It extends aft of this by a short distance to enable survivors to swim and crawl onto it.

For guidance to reach the vicinity of the survivors, the lifeboat is equipped with a communication apparatus including a receiver for receiving survivor location data. In addition, the navigation apparatus with which the lifeboat is equipped includes a GPS system of its own, and a compass. The lifeboat is also equipped with a control system. The latter computes a course to the survivors by comparing its and survivor positions. The control unit has an output module for controlling the propulsion units to drive the lifeboat to the survivor position.

The present invention aims to provide at least an alternative arrangement.

According to the invention, viewed from one aspect, there is provided a life boat comprising:

a hull a propulsion system, and a manned or unmanned conning system, wherein the hull has:

an open or openable bow, an open, partially covered or covered fore deck and a powered recovery ramp installed in or on the fore deck for deployment forwards of the bow for recovery of a casualty ahead of the bow.

Viewed from another way, the present invention can be seen to provide a life boat with a casualty recovery ramp that is arranged forrard.

The powered recovery ramp preferably has a conveyor on its upper, when deployed, surface in the form of a belt which is driveable back towards the bow for conveying a casualty on-board from the water.

The belt may be the width of the recovery ramp or the recovery ramp may comprise a plurality of narrower belts across its operational width. Such narrow belts may be spaced apart or may abut edge to edge. Where there are a plurality of belts, the belts may be arranged to be driven at the same speed, for example, via a common drive shaft.

The belt or belts may be provided with width-wise slats.

The slats may project from an outer surface of the belt or belts by an amount of 1 cm or more, more preferably 2.5 cm or more. The slats may be configured to grip and pull the survivor on-board from the water without active involvement from the survivor, for example, to rescue a survivor in the situation where the survivor is unconscious or otherwise incapacitated.

The slats may extend width-wise at ninety degrees to the operational width of the recovery ramp or they may extend with a slight inclination to the direction of motion, for example, towards a central region of the recovery ramp to help draw the survivor towards that central region as he/she is pulled on-board the vessel. The inclination of the slats may be up to 30°, more preferably a smaller amount, for example, in the range of 1 to 20°. The slats may be made from a stiff but still flexible material, such as a rubberised material or polymerised material like silicone, to allow movement around the ends of the ramp, or the slats may be coupled to the belt in a way to allow such movement, for example, by being anchored to the belt at a portion of the slat, e.g., a central region of the slat.

The slats may also have a projection amount that varies from slat to slat in the direction of movement of the conveyor, and/or across the width-wise direction of the conveyor. For example, this might be achieved through a projection amount that varies along the length of the slat in the width-wise direction of the recovery ramp, e.g., having a greater projection amount towards the side portions than the middle to encourage movement of the survivor towards a central portion of the conveyor. Or this might be achieved through varying the extent of the projection from one slat to the next across the width of the recovery ramp, for example, through arranging slats of different heights on different belts of the conveyor.

The width-wise slats may include formations like apertures, claws, grips, portions of different materials, etc., to aid the drawing of the survivor on-board the vessel from the water.

For deployment, the recovery ramp can be mounted on side guides with means for thrusting the recovery ramp forwards, for its forrard, when stowed, end to droop into the water when fully extended.

For example, the recovery ramp may be coupled to a mounting that has been attached to the vessel, the mounting allowing a displacement forwards of the recovery ramp, from a stowed position, over or out of the bow of the vessel into a deployed position where one end of the ramp is on-board the vessel and the other is in the water. Actuators such as springs, gas-powered actuators, electrically-powered actuators and the like, can be used to deploy the recovery ramp from the bow of the vessel. The actuators may release the recovery ramp from any locking devices securing the recovery ramp to the vessel in a stowed position, and thrust the recovery ramp forrad, on receipt of an activation signal from a control system.

These actuators, or other similar actuators, may also be responsible for moving a portion or portions of the bow, to open the bow prior to forward displacement of the recovery ramp during deployment of the recovery ramp into the water. The movement of the bow portion(s) may be coordinated with the deployment of the recovery ramp through linkages or other mechanisms, so that all the movements can be controlled and automated.

The mounting may include rails, tracks or guide surfaces to guide the displacement of the recovery ramp into the deployed position. Rollers or wheels may be provided to cooperate with the rails, tracks or guide surfaces during the displacement of the recovery ramp. The recovery ramp may move through an angle during deployment. For example, the recovery ramp may be stowed substantially level with the fore deck and then deployed to an angle of inclination of between 25 and 70° to the fore deck, more preferably an inclination of between 30 and 60° to the fore deck (while allowing for relative movement of the vessel and recovery ramp). In another embodiment the recovery ramp may be stowed at an inclination to the fore deck (with the forrad end lower than the aft end). In this way gravitational forces can be used to assist in the deployment of the recovery ramp. It may also facilitate the fitting of a second conveyor on the fore deck below the recovery ramp for conveying the survivor from the on-board end of the recovery ramp to a more central portion of the vessel, for example to an enclosed region of the vessel that can provide more shelter for the survivor.

The recovery ramp may be installed in a fore deck environment below the top of the sides of the vessel. It may also be stowed at a higher position and may provide a roof to the foredeck area when stowed. In a further arrangement it may be stowed on top of the fore deck of the vessel where the vessel has a raised fore deck portion.

In all cases, the stowed position should be one where the recovery ramp is stowed securely in a manner which can resist storm force conditions and rough seas.

The mounting may include a mechanism that allows the recovery ramp to pivot with respect to the vessel when deployed, to allow the vessel to move with the motion of the water (which might be an extremely rough sea) while trying to maintain the end of the recovery ramp in the water as still as possible to aid the recovery of the survivor.

The recovery ramp may also be pivotally mounted at a forrard, when stowed, end and provided with a mechanism or other means for pivoting the recovery ramp about the pivoted end, whereby the aft end when stowed deploys forwards and droops into the water.

A further alternative is a combination of an initial forwards movement to place the pivoted end forwards of its stowed position, for example, as a substantially linear movement forward, followed by pivotal final deployment.

In any case the aft end of the deployed ramp may be level with or above a fixed foredeck.

However, it is preferred that the deployed aft end is level with or above a secondary conveyor extending aft from the bow, with the deployable ramp overlying the secondary conveyor prior to deployment. This arrangement allows a casualty, who may be unconscious or incapacitated, to be conveyed inboard of the bow, before being deposited on the deck, where others may be able to assist him/her. It should be noted that casualties are likely to be incapacitated from long immersion to the extent of being unable to help themselves up the ramp.

Normally the life boat will have an amidships deck, substantially level with the fore deck or cockpit area between the aft end of the deployable ramp or secondary conveyor. The amidships deck may be forrard of closed accommodation, accessible from the fore deck or cockpit via a hatch. The decks or cockpit can be self-baling in the normal manner to help reduce swamping in this region.

The bow can be open to the level of the fore deck or the powered recovery ramp prior to deployment. The latter can be arranged to fold onto the secondary conveyor where provided or it can be provided at a higher level with low forrard-transom at the forrard end of the fore deck or secondary conveyor, with the bow being open above the forrard-transom to allow for deployment of the powered conveyor.

Alternatively, the boat can be provided with a fo'c'sle at least partially enclosing the foredeck at the bow and having a door. The door can be arranged in an up-and-over manner or as a pair of sideways opening doors. The deployable ramp can be arranged within the fo'c'sle on guides inclined downwards for deployment.

In an embodiment where the bow door is arranged to open in an up-and-over manner, this arrangement may have significant advantages in terms of providing the structural integrity at the bow to allow the life boat to be launched bow first from a raised launch position, for example, as a free fall launch from a launch slide mounted to a ship or support structure on a wind turbine or oil or gas rig. The bow door may be arranged to open up and over the stowed recovery ramp on the fore deck. The bow door may comprise a pair of arms connected to pivots on the side of the vessel to allow it to open in an up and over manner.

As an alternative, a shutter may be provided to enclose, either wholly or partly, the recovery ramp within the foredeck. The shutter may be arranged to open and close, either wholly or partly, the foredeck, optionally in a longitudinal direction of the boat. When closed, the shutter can provide a sheltered and enclosed area for weather protection of the recovery ramp. The shutter may also provide for shelter and/or cover of an (the) enclosed region for any persons that have been recovered to the boat when closed. When opened, the shutter can allow for deployment and retraction of the recovery ramp. When opened, the shutter may also permit survivors to access an (the) enclosed region.

However in one optional life boat, there is no fo'c'sle as such and the bow has:

a pair of side hinged bow doors and means for opening the doors, extending them forwards at least parallel to each other.

Whilst the doors may be hinged about nominally upright hinge axes, preferably the hinge axes are inclined forwards, whereby the doors are inclined downwards when open.

To allow the powered recovery ramp to deploy, the fore deck may be a flying deck at the bow, that is extending athwart the bow at the stem of the hull. As such the bow doors may be normally above the waterline of the hull. Thus the doors can themselves extend athwart-ships parallel to each other. In an optional embodiment they meet at a shallow angle compared to the sides of the hull at the stem.

Along either side of the fore deck gunwales extend, optionally including a flying portion on either side of the bow. Optionally the doors are hinged at the forrard end of the gunwales.

The powered recovery ramp may be installed integrally as part of building of the life boat, or may be retrofitted to the life boat (i.e. after the remainder of the lifeboat has already been built and/or assembled together).

In a further aspect of the invention, there is provided a method of recovering a casualty using the life boat according to the first aspect. The method comprises: deploying the recovery ramp forwards of the bow of the life boat; and recovering a casualty to the life boat using the deployed recovery ramp, wherein the casualty is positioned ahead of the bow of the life boat. The life boat used in this aspect may be in accordance with any optional features of the lifeboat as set out above.

In yet a further aspect of the invention, there is provided a method of manufacturing a lifeboat, comprising providing a hull, wherein the hull has an open or openable bow and a fore deck; attaching a propulsion system to the hull, providing a conning system in communication with at least the propulsion system, and installing a powered recovery ramp in or on the fore deck for deployment forwards of the bow for recovery of a casualty ahead of the bow of the life boat.

This aspect of the invention may result in the life boat of the first aspect of the invention, optionally in accordance with any optional form thereof.

The step of installing the powered recovery ramp may occur at a subsequent point in time to the other steps of the method such that the step of installing the powered recovery ramp is a step of retrofitting the recovery ramp.

Further optional features of the invention are set out below in the dependent claims.

To help understanding of the invention, embodiments thereof will now be described by way of example and with reference to the accompanying drawings, in which.

Figure 1:
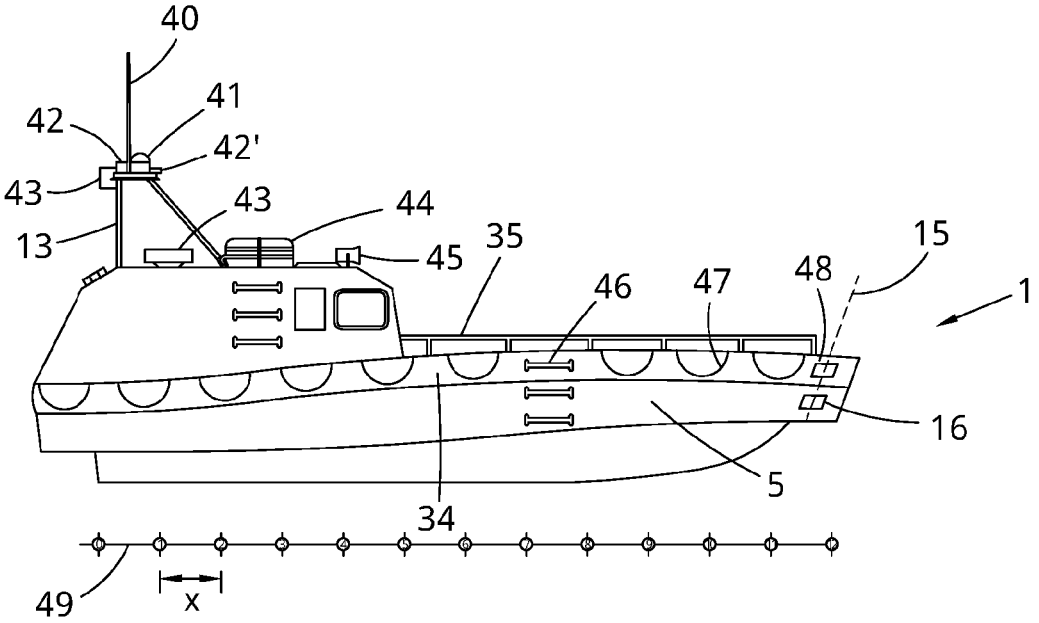
FIG. 1 is a side view of an embodiment of a life boat of the invention.

Referring to the exemplary embodiment of FIGS. 1 to 4 of the drawings, the life boat 1 has a hull with a conventional hull form below the waterline WL. For propulsion, a pair of water jets 2 (see FIG. 4) are provided aft, normally electrically powered with batteries 3 stowed amidships below a fore deck 4. Other propulsion systems are of course possible.

Bulwarks or gunwales 5 extend along the sides of the fore deck 4 and blend into accommodation 6 aft. A hatch 7 gives access to the accommodation 6 from the fore deck 4.

The life boat 1 is equipped for autonomous conning. A manual conning station 8 may be provided in the accommodation 6 to allow for manned operation, for example after a survivor has been rescued or otherwise.

In this exemplary embodiment, the life boat 1 is equipped with seats 9 for recovered casualties, stretchers (not shown) and other emergency equipment.

At the bow 12, the fore deck 4 has flying portions 11 extending to either side of the bow 12 as it fines towards the stern 14. The gunwales 5 follow the edges of the fore deck 4. At their forrard end they project slightly at the tops, providing forwards tilted hinge axes 15 and hinge points 16 for bow doors. When closed these meet forrard of the bow 12 at the front 17 of the fore deck with an angle $\alpha$, which is shallow with respect to the sides 18 of the hull at the bow 12. Tilting forwards of the doors' hinges 15 causes them to slope down towards the water when opened by actuators 19, not shown in detail.

Between the gunwales 5 in a forrard part 21 of the fore deck 4, a powered recovery ramp 22 is provided. The recovery ramp is provided with a conveyor on an upper surface thereof that is in the form of a belt 24 or plurality of belts 24. The belt 24 or belts 24 is/are driven in a direction from in front of the bow 12 aftwards towards the fore deck 4 of the boat 1.

In this embodiment, the boat 1 has a fixed, lower secondary conveyor 23 to which the recovery ramp 22, comprising its conveyor, is pivoted. Both conveyors (as has already described above in connection with the recovery ramp 22) have belts 24 extending around them with cross-slats 25 for engaging with casualties unable to swim onto them—or at least onto the recovery ramp 22 when deployed. The slats 25 extend substantially width-wise to the lower conveyor 23 and the conveyor of the recovery ramp 22, and they may have different heights, features, angulations etc., to help assist with capture of a casualty, in particular when the recovery ramp 22 is steeply inclined into the water (which may of course be rough or extreme sea conditions) to draw the casualty into safety out of the water on-board the life boat 1. The life boat 1 may be unmanned and this action may need to be performed without the assistance of a human and when the casualty is unconscious or has lost some capacity.

Prior to deployment, the recovery ramp 22 comprising the upper conveyor lays on the lower conveyor 23. The lower conveyor 23 and the recovery ramp 23 are pivotally connected at the forrad end of the lower conveyor 23. That is to say frames 26,27 of the lower conveyor 23 and the recovery ramp 22, respectively, are pivotally connected at an axis 28. Actuators 29 are provided at opposite sides for pivoting the recovery ramp 22 forwards through some 200° in the water ahead of the bow 12. The belts 24 of the lower conveyor 23 and the recovery ramp 22 are drivingly connected and provided with a motor 30 at the aft end of the conveyor lower conveyor 22.

In an alternative embodiment, the lower conveyor 23 and the recovery ramp 22 may be stowed one above the other as the previously described embodiment. However, during deployment of the recovery ramp 22, the recovery ramp 22 may be displaced forward, for example, along guides at the sides of the recovery ramp 22, which guide the recovery ramp 22 and its upper conveyor out through the open bow 12 to a deployed position where its forrad end is pivoted down into the water for rescuing a casualty and its aft end is mounted (in a pivotal manner) in a position over a bow 12 region of the fore deck 4 and the lower conveyor 23.

The recovery ramp 22 preferably comprises an aperture structure, with apertures provided in the belts 24 and panels of the recovery ramp 22 to allow waves to break through the structure. In rough seas this reduces the amount of movement which is otherwise induced when recovery ramp 22 when deployed in the water. It also helps to avoid the survivor from being washed off the end of the recovery ramp 22.

For operation, the life boat 1 is manoeuvred to be just downwind of a casualty, the doors having been opened and the powered recovery ramp 22 deployed. The belts 24 are set in motion, with their upper runs 31 moving inboard. The doors extend alongside the recovery ramp 22, resisting any wave action to wash a casualty off to one side. The belts 24 draw the casualties aboard, with the slats 25 engaging with their bodies, transferring them from the recovery ramp 22 to the lower conveyor 23, for depositing onto the fore deck 4 in an aft region or rescue cockpit 32.

Conscious casualties, who have not been incapacitated by a long immersion or otherwise, can crawl up recovery ramp 22 and/or the lower conveyor 23 and access the accommodation 6 via the hatch 7. Other persons overboard, conscious and not incapacitated, can climb aboard via ladder rungs 46 set in the gunwale 5 and over an inflatable sponson 34 and gunwale top rails 35. These latter provide a degree of protection to survivors working in the cockpit 32, helping for instance incapacitated casualties into the accommodation 6, possibly with a stretcher.

Once all casualties have been recovered, the recovery ramp 22 is retracted and withdrawn over the bow 12 and the bow doors closed, whereupon the life boat 1 can make passage to a safe haven. This process may be performed with the actuators 29 working in reverse to withdraw the recovery ramp 22 to a stowed position on the life boat 1 and any bow doors shut before the life boat 1 makes passage.

Other features shown in FIG. 1 are as follows. The life boat 1 may be provided with VHF antennas 40 mounted to a support structure 13 (a vessel mast) fitted to a roof of the life boat 1. The support structure 13 may also carry a FLIR search camera (an infra-red search camera) and/or 360 degree camera 41 which may be IR. The support structure 12 may further carry GPS antennas 42,42' and navigation lights 43. On the roof of the life boat 1 a life raft 44 may be mounted and a search light and horn 45 fitted.

On the sides of the life boat 1, as previously mentioned, there may be provided man-over-board (M.O.B.) ladder rungs 46 for a casualty to pull themselves up the side of the life boat 1 to climb on-board where that is possible. Grab handle ropes 47 may be provided along an inflatable sponson collar 48 to help a survivor make their way onto the life boat 1.

Figure 2:
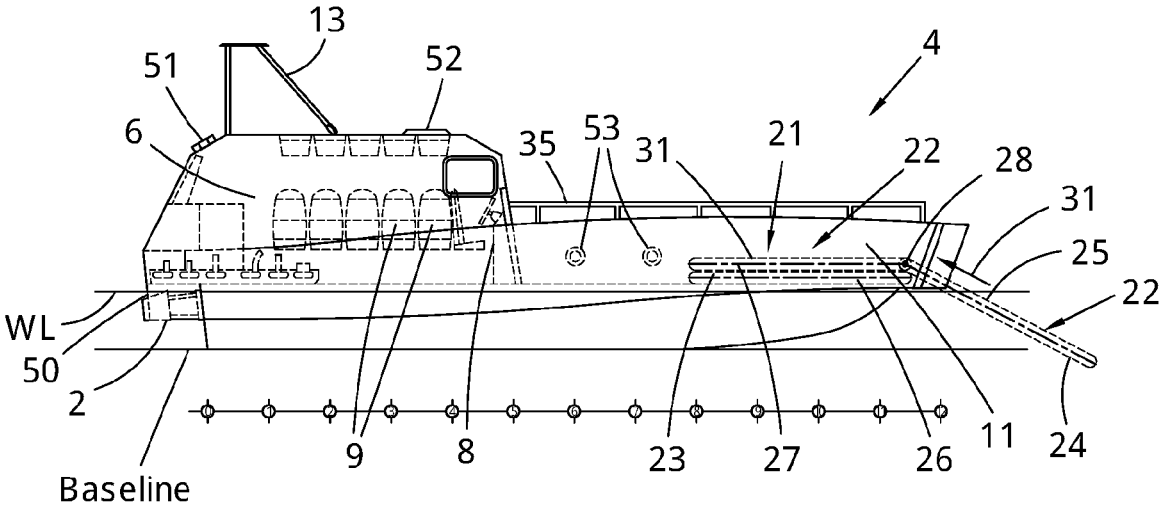
FIG. 2 is a part cross-sectional view showing interior features of the life boat of FIG. 1.
Figure 3:
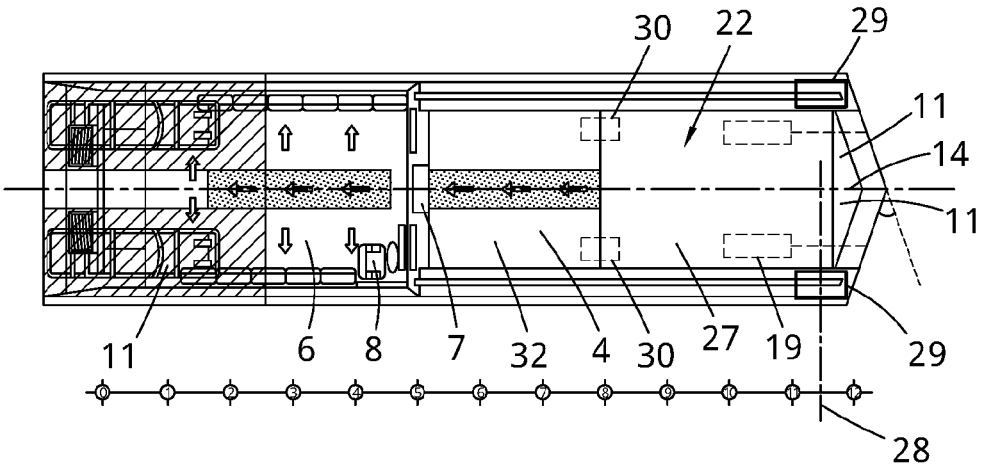
FIG. 3 is a main deck plan view of the life boat.
Figure 4:
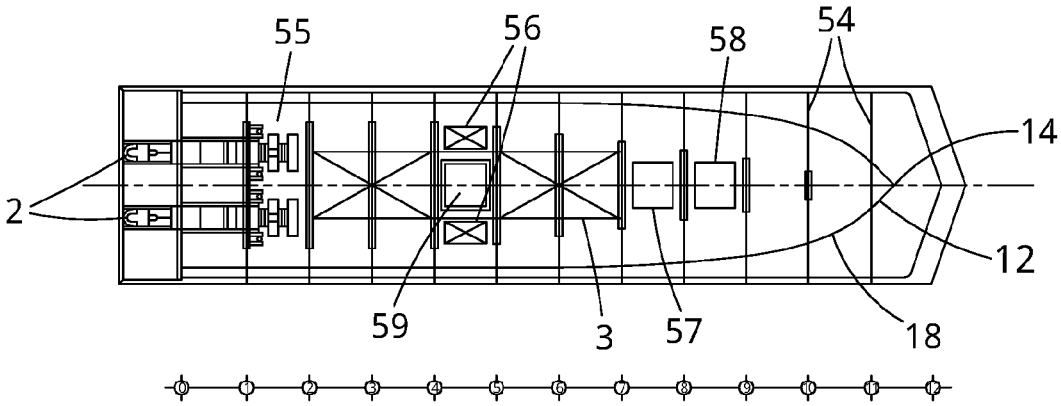
FIG. 4 is a below deck view similar to FIG. 3.

At the bottom of FIGS. 1 to 4 is shown a scale 49 indicating the position of the structural ribs 54 indicated in FIG. 4. As indicated, there may be 12 structural ribs 54 which define the shape of the hull. These ribs 54 may be at a set spacing, x, e.g., of 800 mm. Other numbers of ribs 54 and other arrangements of structural support are also possible.

As shown in FIG. 2, the region around the water jets 2 of the propulsion system may be constructed as a cabin 50 designed to provide in-built protection for the aft portions of the water jets 2.

On the roof of the life boat 1, vessel recovery lifting points 51 may be provided for hoisting the vessel back up a launch slide or other structure when the life boat 1 is not in use. The vessel recovery lifting points 51 may be Launch and Recovery System (LARS) lifting points as used for remotely operated underwater vehicles (ROVs).

The vessel mast 13 may be designed to fold during stowage/transport procedures as well as launch and recovery procedures, to avoid risk of damage.

A cabin escape hatch 52 leading to a superstructure roof may be provided on the life boat 1 to allow survivors to escape the life boat 1 should that vessel also get into difficulties and need to be evacuated.

Tubular railings 35 on the bulwark are able to provide additional height protection for any casualties in the cockpit safe zone.

Speakers 53 fitted to the port and/or starboard sides of a rescue area may be used to convey audio instructions to a casualty. The rescue area may be left as clear as possible of other equipment in order to provide ample area for handling survivors. Signs may be positioned around the rescue cockpit 32 for displaying instructions to survivors on-board.

FIG. 3 shows a plan view of the life boat 1 with some of the internal detail of the accommodation 6 visible. In addition to what is shown, the accommodation 6 may include a large medical procedures instructional screen and a medical storage area. There may be allocated space on the port and starboard sides for stretcher areas and medical cabinets. There may additional signs and information within the accommodation 6, for example, casualty instructions. The accommodation 6 is fitted with a watertight entry door (hatch 7) with an easy to use large round spoke wheel to open and close the door. There may be folding seats to port and starboard in the accommodation 6, for example, to accommodate up to 12 persons. There may be storage points for roll up personal first aid kit bags above the seats 9. A manual override helm controls 8 may be provided, for example positioned to starboard.

In FIG. 4, more internal and structural detail of the life boat 1 can be seen. The life boat 1 may be constructed around an array of structural ribs 54, spaced at intervals down the length of the life boat 1 and extending transversely, which define the shape of the hull at each given point. The structural ribs 54 may include apertures (not shown) defining conduits for the propulsion system components and other components.

In FIG. 4, twin water jet propulsion engines 2 are shown at the stern of the life boat 1. These may be driven by twin electric motor units 55. Other propulsion systems are also envisaged. For example, the propulsion system could be a twin diesel motor and gearbox arrangement.

The electric motor units 55 may be driven by the main battery banks 3 and other service battery banks 56 may be used to power other functions. An air conditioning unit 57 may be provided for the cabin 6. A hydraulic power pack 58 may be provided for the conveyor belt machinery systems. The life boat 1 could also include a Seakeeper device 59 towards the centre of the life boat 1 for assisting with roll reduction.

Figure 5:
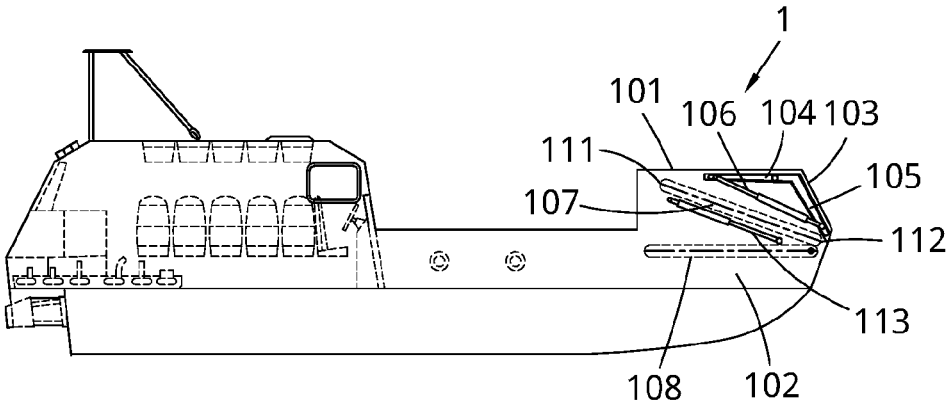
FIG. 5 is an amidships side elevation of a second exemplary embodiment of a life boat of the invention with its forwards deployable ramp stowed.
Figure 6:
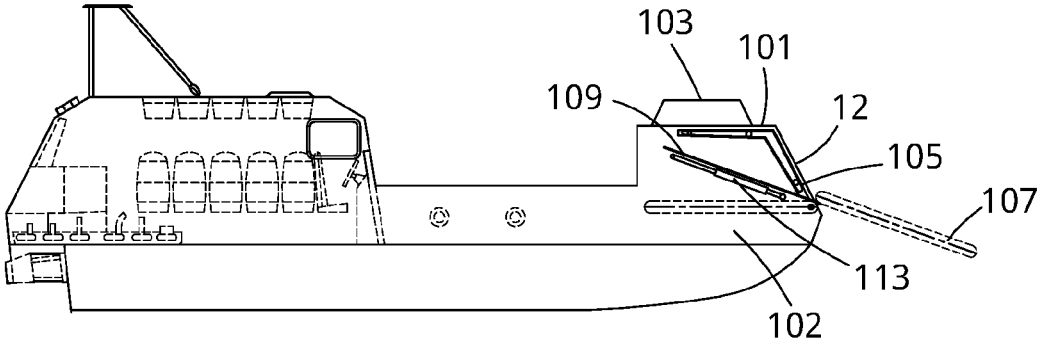
FIG. 6 is a similar view of the second exemplary embodiment of the life boat with its ramp deployed.

Referring now to FIGS. 5 & 6, an exemplary embodiment of a further life boat 1 shown. The lifeboat 1 of FIGS. 5 & 6 is largely similar to that of the lifeboat 1 of FIGS. 1 to 4, except for its forrard end and the deployable recovery ramp. The forrard end of the lifeboat 1 of FIGS. 5 and 6 has a fo'c'sle 101, providing cover over the fore deck 102. At the bow, the fo'c'sle has an aft-inclined door 103 guided on runners 104,105 to the side and top of the fo'c'sle so that door can be opened in an up and over manner (further details of which can be seen in FIGS. 7 and 8). Telescopic actuators 106 are provided for opening the door to expose a deployable recovery ramp 107 and the fore deck 102 or at least a secondary ramp 108 on the fore deck within the fo'c'sle. Below the runners 104,105, further runners 109 are provided for the aft end of the deployable recovery ramp 107. Along its side edges, it has other runners (not shown). The aft end of the ramp has rollers 111 engaging in the runners 109 and at the bow, rollers 112 mounted at the forrard corners of fore deck engage in the runners on the recovery ramp 107. Actuators 113 extend along the runners 109 and engage the recovery ramp at its rollers 111.

After opening of the door 103, operation of the actuators 113 deploys the recovery ramp 107 to bring the rollers 111 forward into a position that the rollers 112 would have been whilst the recovery ramp is in a stowed position. The rollers 112 are thrust overboard from the lifeboat 1 during deployment such that the rollers 112 at the forward most end of the recovery ramp 107 extend to sea. The motor (not shown) of the recovery ramp 107 can then be operated for casualty retrieval in a similar manner to that discussed above in connection with FIGS. 1 to 4.

Figure 7:
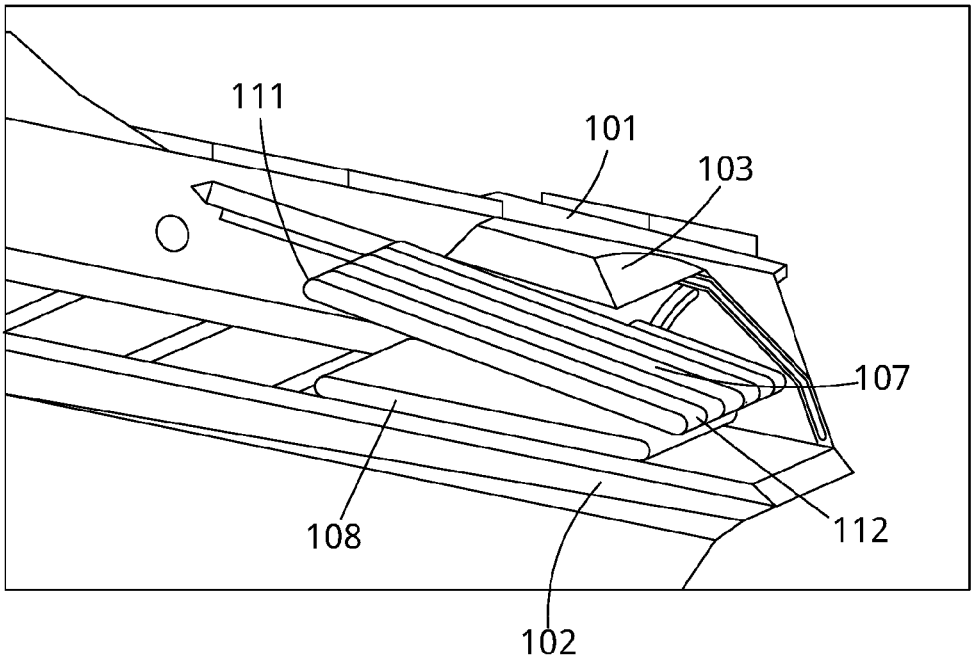
FIG. 7 is an enlargement of the bow detail showing the recovery ramp in an on-board position once the bow door has been opened.

FIG. 7 shows the bow region of the fore deck 102 in more detail. The upper deployable recovery ramp 107 is guided in C-shaped supports at its forrad and aft ends by rollers 111, 112. The forrad C-shaped supports may be mounted to pivot through cooperation with slots in side plates on either side. In this way, the deployable ramp can slide forwards and then pivot to lower the forrad end of the deployable ramp 107 into the water once the bow door 103 has opened and pivoted over the top of the fore deck 102. Once deployed, the aft end of the deployable recovery ramp 107 may substantially align with the forrad end of the secondary ramp 108, to help convey a survivor aftwards onto the fore deck 102 and further into the life boat 1, e.g. into an accommodation or cockpit of the lifeboat.

Figure 8:
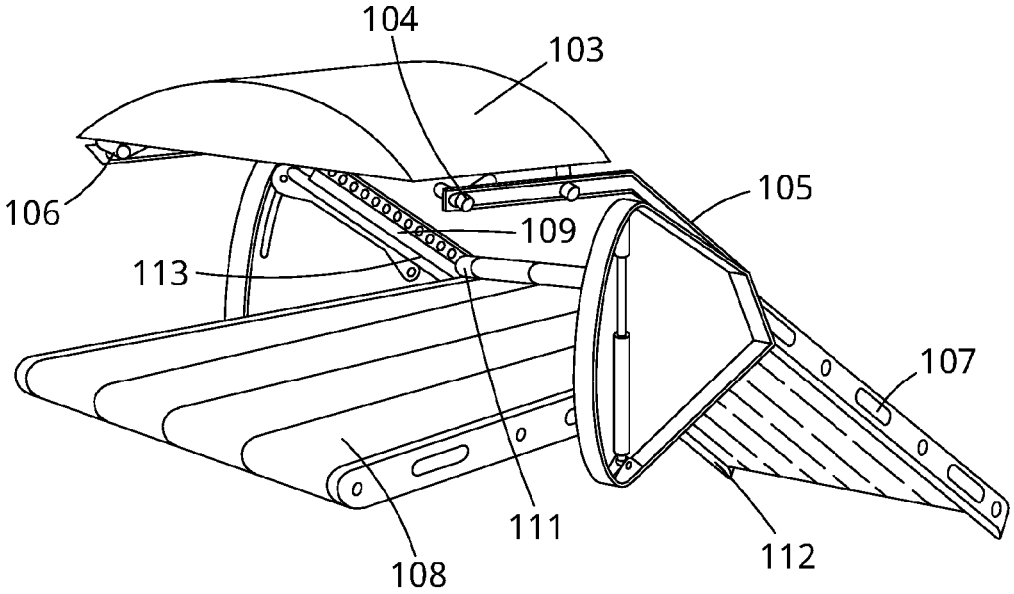
FIG. 8 shows the recovery ramp of FIG. 7 in a deployed position, extending from the bow of the life boat.
Figure 9:
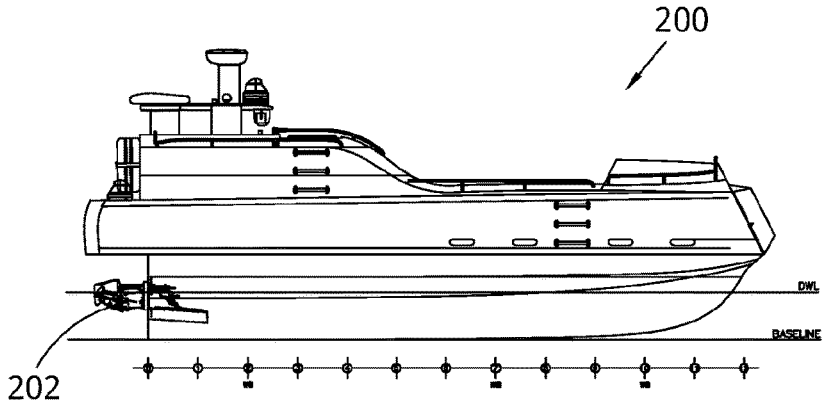
FIG. 9 is a side view of a third embodiment of a life boat of the invention.
Figure 10:
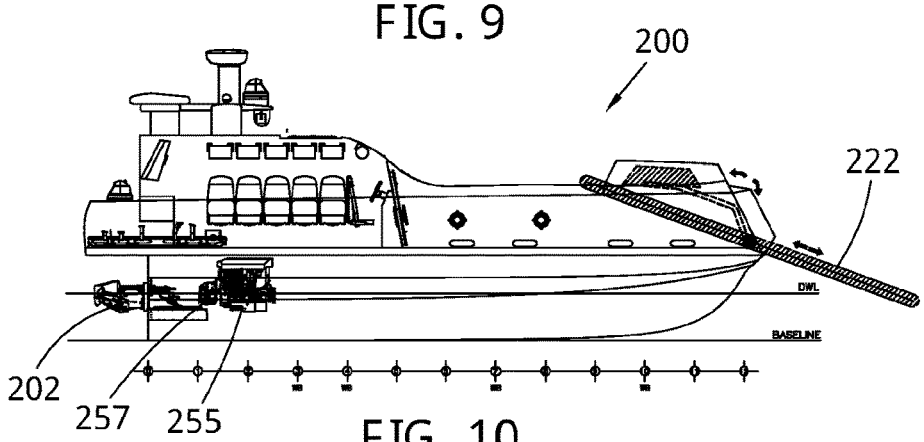
FIG. 10 is a part cross-sectional view of the life boat in FIG. 9 showing interior features of the life boat and the recovery ramp in a deployed position.
Figure 11:
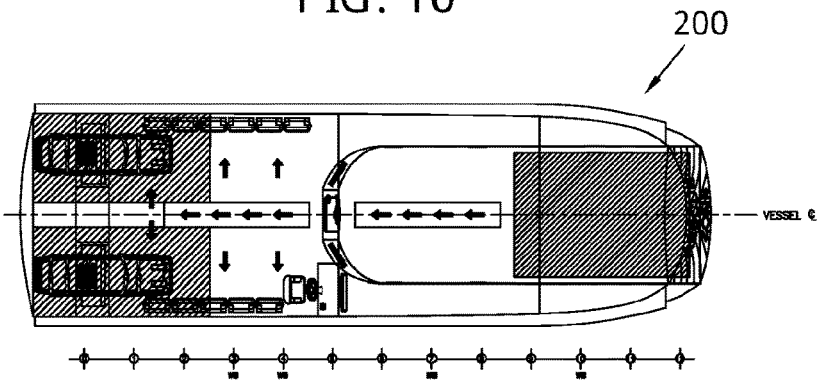
FIG. 11 is a plan view of the life boat shown in FIG. 10 with the recovery ramp stowed and the bow door closed.
Figure 12:
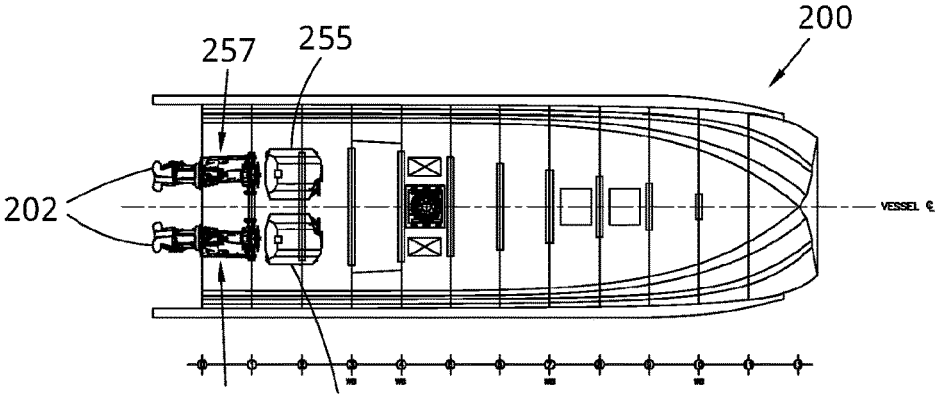
FIG. 12 is a below deck view similar to FIG. 11 showing the internal structure of the life boat.
Figure 13:
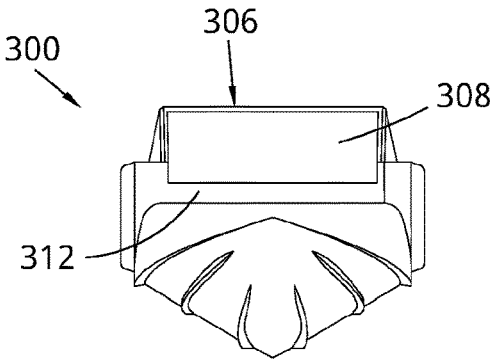
FIG. 13 is a bow view of a fourth embodiment of a life boat of the invention.
Figure 14:
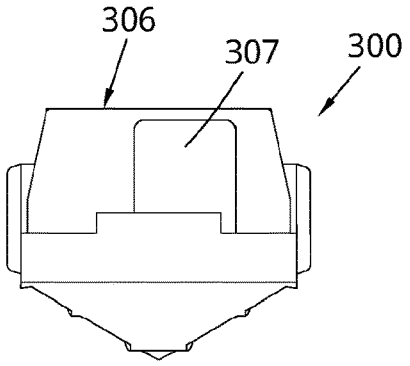
FIG. 14 is a stern view of the life boat shown in FIG. 13.
Figure 15:
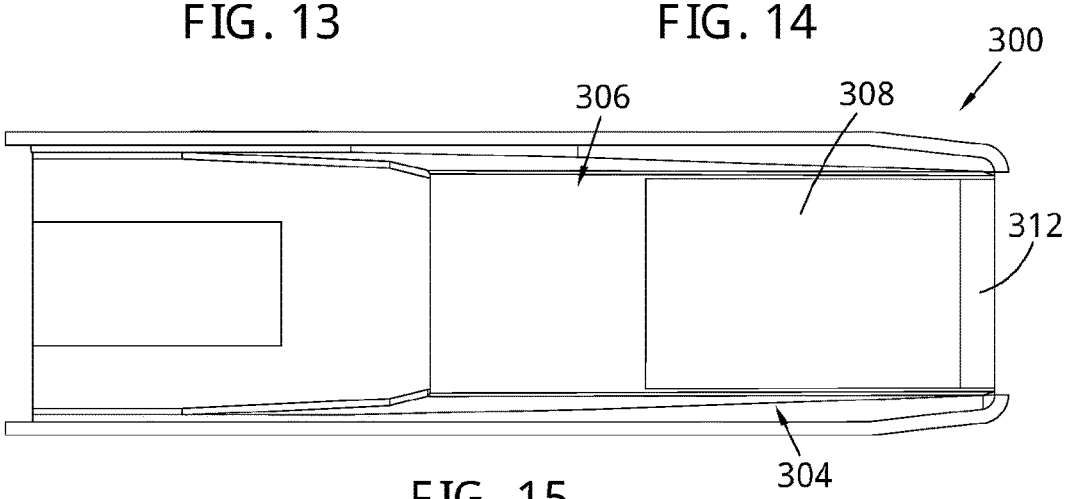
FIG. 15 is a plan view of the fourth embodiment of the life boat showing the stowed configuration of the recovery ramp.
Figure 16:
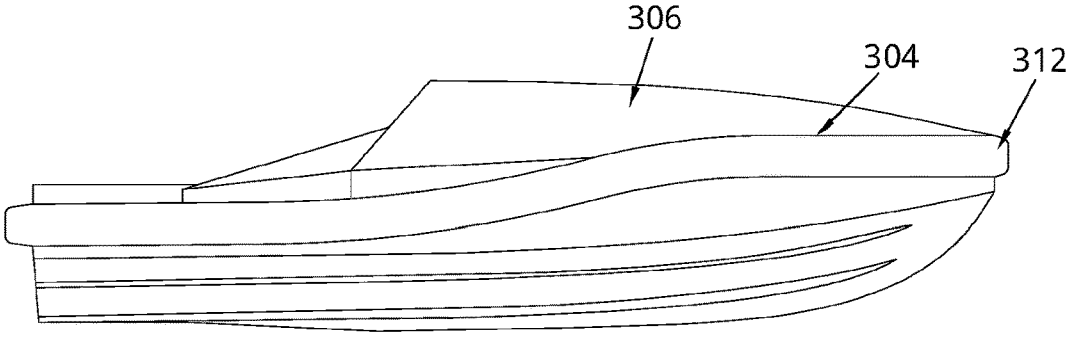
FIG. 16 shows a side view of the fourth embodiment of the life boat.
Figure 17:
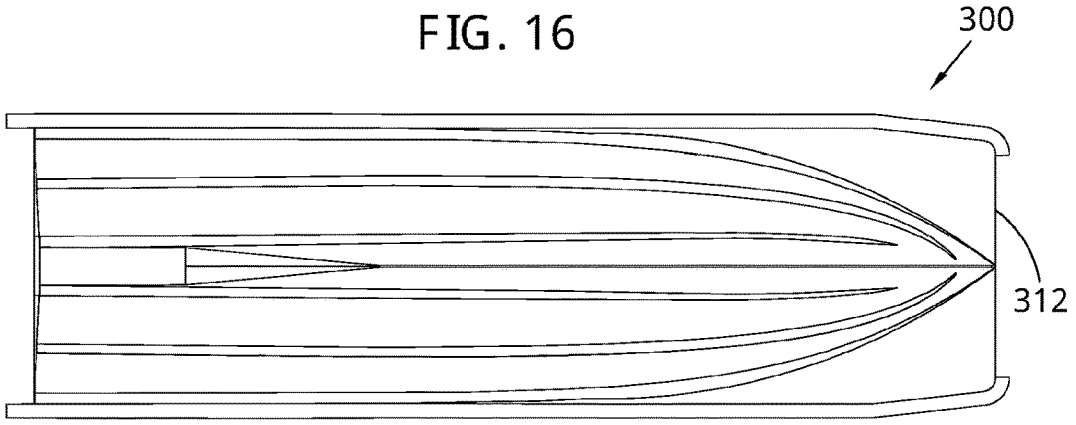
FIG. 17 shows an underside view of the fourth embodiment of the life boat.

FIG. 8 shows more details of the deployable ramp 107 in a deployed position with the detail of the vessel omitted.

The deployable ramp 107 and the secondary ramp 108 may be constructed in a similar manner with an apertured structure to allow the water to pass through. The conveyors may also comprise a plurality of belts as shown. The belts may be provided with width-wise slats to assist with drawing the survivor on-board.

FIGS. 9 to 12 shows a further alternative embodiments of a life boat 200. The life boat 200 is broadly similar to the embodiments of the life boats described above with reference to FIGS. 1 to 7. In particular, the life boat 200 shares many similarities with the life boat 1 depicted in FIGS. 5 and 6.

The primary differences between the life boat 200 and the life boats 1 of FIGS. 1 to 8 reside in their respective propulsion means and the nature of their recovery ramps.

With regard to the first of these differences, the life boat 1 of FIGS. 5 and 6 comprises twin water jet propulsion engines 2 are which are driven by twin electric motor units 55, which in turn are powered by battery banks 3. In contrast, the lifeboat 200 of FIGS. 9 to 21 comprises two inboard, diesel powered motors 255 that are each drivingly connected to a respective gearbox 257 and, in turn, a propeller 202. The propellers 202 act in place of the jet propulsion engines 2 to propel the life boat 202, and these are powered by the two inboard, diesel powered motors 255.

In connection with the second of these differences, as described above, the life boat 1 comprises a powered recovery ramp 2 that is provided with a conveyor on an upper surface thereof which is in the form of a belt 24 or plurality of belts 24. The belt 24 or belts 24 is/are driven in a direction from in front of the bow 12 aftwards towards the fore deck 4 of the boat 1. The boat 1 further comprises a lower secondary conveyor 23 to which the recovery ramp 22 is pivotally connected. Prior to deployment, the recovery ramp 22 comprising the upper conveyor lays on the lower conveyor 23. During deployment, the recovery ramp 22 is pivoted relative to the lower conveyor 23 and is also thrust forward such that it extends to or through the waterline to permit rescue of overboard person.

In contrast, the life boat 200 comprises recovery ramp 222 and no equivalent to the lower conveyor 23 is provided on the lifeboat 200. The recovery ramp 222 is angled relative to the life boat 200 and is linearly translatable through the bow door of the life boat 200, once opened, between a stowed position and a deployed position. This is in a manner comparable to the deployment of the recovery ramp 107 of FIGS. 5 to 8. Actuators (not shown) are arranged to deploy and retract recovery ramp 222 between the stowed and deployed position. In the deployed position, the forrard end of the ramp is arranged to extend to or through the waterline of the boat 200. In the stowed position, the entire recovery ramp 222 is housed within the fore deck 4 of the life boat 200 such that the bow doors can be closed to provide an at least partially enclosed and weather protected space at the fore deck in which the recovery ramp 222 is held. The recovery ramp 222 may be mounted onto the boat 200 in a manner that permits a limited pivotal movement (as limited by the dimensions of the opening at the bow door) such that the angle of the recovery ramp 222 relative to the boat 200 can increase. This has the effect that the forrard end of the recovery ramp 222 can be raised and lowered further than is permitted simply by linear translation of the recovery ramp 222. The recovery ramp 222 comprises a conveyor comprises belts and a motor comparable in arrangement to those described above in relation to recovery ramp 22.

FIGS. 13 to 17 show further alternative embodiment of a lifeboat 300. The lifeboat comprises an accommodation area 306 that occupies the foredeck 304 of the lifeboat 301. The accommodation area has a hatch 307 for entry to the accommodation area 306. As shown in FIGS. 13 to 17, situated above and covering the accommodation area 306 is a retractable shutter door 308. The shutter door 308 is retractable from the bow 312 of the life boat 300 such that, in a retracted position, the bow 312 is open and a recovery ramp 322 (see FIG. 18) that is housed within the accommodation area 306 just below the shutter door is exposed to an exterior of the lifeboat 300. Whilst the shutter door 308 is in the retracted position, the recovery ramp 322 is capable of being deployed from its stowed position (i.e. housed in the accommodation area 306) and through the open bow 312 through linear and pivotal movement of the recovery ramp 322 relative to the remainder of the boat 300 (e.g. in a manner comparable to that described above in connection with recovery ramp 222) such that the recovery ramp 322 can extend to or through the water line to permit rescue of overboard persons—a deployed position. Such persons can be brought on-board the lifeboat 300 via the recovery ramp 322 to the accommodation area 306 where they are able to take refuge.

After deployment (and optionally after overboard persons have been recovered), the recovery ramp 322 can be retracted to a stowed position (e.g. as shown in FIGS. 13 to 17) at which time, the shutter door 308 can be closed to enclose and provide weather protection to the accommodation area 306.

Figure 18:
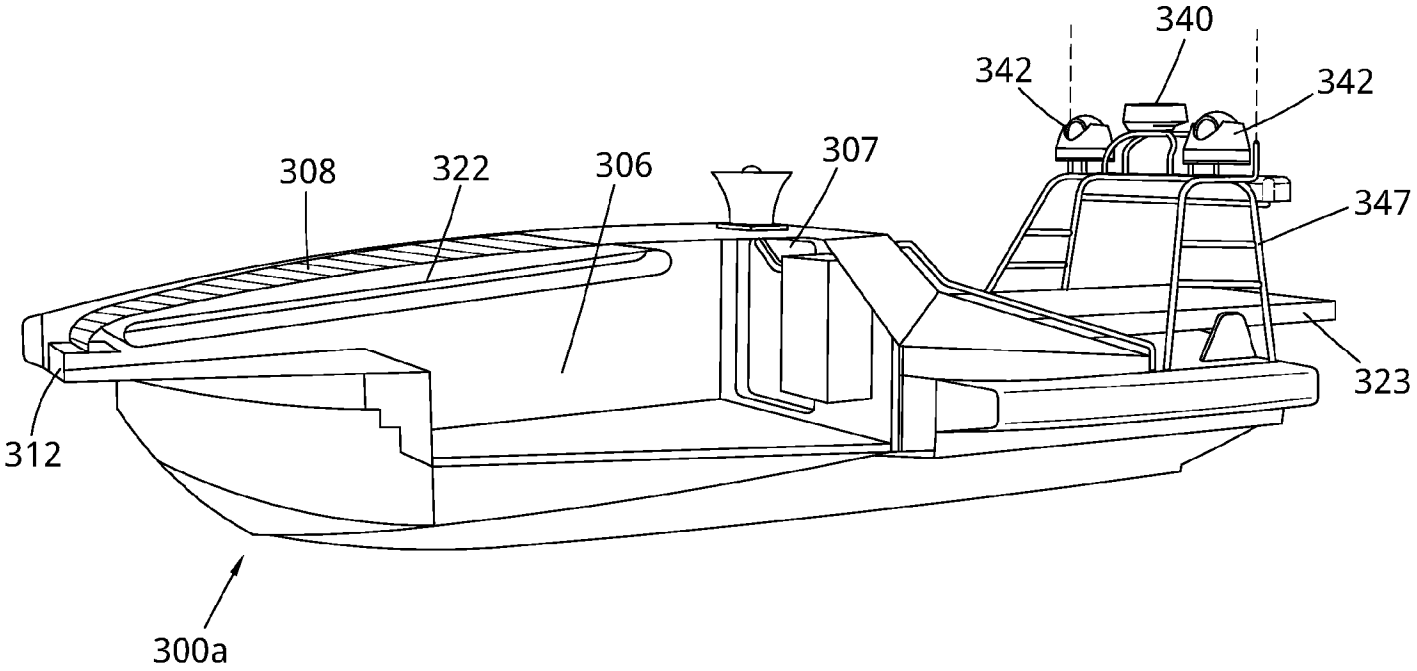
FIG. 18 shows a modified form of the life boat of the fourth embodiment.

FIG. 18 shows a modified version of the lifeboat 300 of FIGS. 13 to 17, denoted **300*a*. The lifeboat 300*a* comprises all of the same features as lifeboat 300, and in fact further detail of the shutter door 308, recovery ramp 322 and survivor pod 306 that are common to both the life boat 300 and the life boat 300*a* can be seen FIG. 18. The life boat 300*a* further comprises a search horn 345 fitted atop the accommodation area 306, and a gantry 347 fitted with antennas 340 and cameras 342 for communication and search purposes. An additional recovery ramp 323 is also mounted at a stern of the life boat 300. The recovery ramp 323 is deployable and a retractable in a manner comparable to recovery ramp 322 and provides an alternative means for rescue of overboard personnel. Such personnel can access the accommodation area 306 via hatch 307**.

The invention is not intended to be restricted to the details of the above described embodiment. For instance, the distal end of the upper conveyor may be provided with buoyancy whereby it is supported with the very end of the conveyor just below the surface for engagement below casualties and drawing them onto the conveyor.

The invention claimed is:

1. A life boat comprising:

a hull comprising:

an open or openable bow;

a fore deck; and a powered recovery ramp installed in or on the fore deck for deployment forwards of the bow for recovery of a casualty ahead of the bow of the life boat;

a propulsion system;

a conning system; and a deck conveyor situated on a deck of the life boat that is arranged aft of the recovery ramp when deployed such that it can receive a casualty therefrom, wherein the deck conveyor is configured to draw a casualty further inboard on the life boat.

2. A life boat according to claim 1, wherein the powered recovery ramp comprises a conveyor configured for conveying a casualty on-board the life boat.

3. A life boat according to claim 2, wherein the conveyor comprises a driveable belt.

4. A life boat according to claim 3, wherein the belt comprises slats extending across a width of the belt.

5. A life boat according to claim 3, wherein the driveable belt is a single belt that extends over a width of the recovery ramp.

6. A life boat according to claim 1, comprising side guides or side runners, wherein the recovery ramp is mounted on the side guides or side runners in a manner that permits the recovery ramp to move substantially linearly between a stowed and deployed position.

7. A life boat according to claim 6, wherein the recovery ramp is mounted pivotally to the side guides or side runners such that the recovery ramp is arranged to pivot toward a waterline of the life boat before, after or during its substantially linear movement.

8. A life boat according to claim 1, wherein the recovery ramp is pivotally mounted to the life boat at an end in a manner that permits the recovery ramp to pivot between a stowed and deployed position.

9. A life boat according to claim 6, wherein in the deployed position a forward end of the ramp is configured to extend to or through a level of a waterline of the life boat.

10. A life boat according to claim 1, wherein the recovery ramp can overlay the deck conveyor before being deployed.

11. A life boat according to claim 1, wherein the bow is openable, and wherein the bow comprises a bow door to permit opening of the bow such that the recovery ramp can be deployed.

12. A life boat comprising:

a hull comprising:

an openable bow;

a fore deck; and a powered recovery ramp installed in or on the fore deck for deployment forwards of the bow for recovery of a casualty ahead of the bow of the life boat;

a propulsion system;

a conning system; and a shutter door to permit opening of the bow such that the recovery ramp can be deployed.

13. A life boat according to claim 12, wherein the shutter door is arranged to cover and provide weather protection to an accommodation area of the life boat when closed and to permit a casualty to access an accommodation area when open and the recovery ramp is deployed.

14. A life boat according to claim 12, wherein the powered recovery ramp comprises a conveyor configured for conveying a casualty on-board the life boat.

15. A life boat according to claim 14, wherein the conveyor comprises a driveable belt.

16. A life boat according to claim 15, wherein the belt comprises slats extending across a width of the belt.

17. A life boat according to claim 12, comprising side guides or side runners, wherein the recovery ramp is mounted on the side guides or side runners in a manner that permits the recovery ramp to move substantially linearly between a stowed and deployed position.

18. A life boat according to claim 17, wherein the recovery ramp is mounted pivotally to the side guides or side runners such that the recovery ramp is arranged to pivot toward a waterline of the life boat before, after or during its substantially linear movement.

19. A life boat according to claim 12, wherein the recovery ramp is pivotally mounted to the life boat at an end in a manner that permits the recovery ramp to pivot between a stowed and deployed position.

20. A life boat according to claim 17, wherein in the deployed position a forward end of the ramp is configured to extend to or through a level of a waterline of the life boat.

* * * * *